US008473209B2

(12) United States Patent
Nielsen et al.

(10) Patent No.: US 8,473,209 B2
(45) Date of Patent: Jun. 25, 2013

(54) MARKING APPARATUS AND MARKING METHODS USING MARKING DISPENSER WITH MACHINE-READABLE ID MECHANISM

(75) Inventors: Steven E. Nielsen, North Palm Beach, FL (US); Curtis Chambers, Palm Beach Gardens, FL (US); Jeffrey Farr, Jupiter, FL (US)

(73) Assignee: Certusview Technologies, LLC, Palm Beach Gardens, FL (US)

( * ) Notice: Subject to any disclaimer, the term of this patent is extended or adjusted under 35 U.S.C. 154(b) by 478 days.

(21) Appl. No.: 12/429,929

(22) Filed: Apr. 24, 2009

(65) Prior Publication Data

US 2009/0324815 A1 Dec. 31, 2009

Related U.S. Application Data

(63) Continuation-in-part of application No. 11/696,606, filed on Apr. 4, 2007, now Pat. No. 8,060,304, and a continuation-in-part of application No. 11/685,602, filed on Mar. 13, 2007, now Pat. No. 7,640,105.

(60) Provisional application No. 61/075,882, filed on Jun. 26, 2008.

(51) Int. Cl.
*G01C 21/00* (2006.01)

(52) U.S. Cl.
USPC ..... 701/526; 427/136

(58) Field of Classification Search
USPC ..... 427/136, 137; 343/357.13; 701/213, 701/214, 521
See application file for complete search history.

(56) References Cited

U.S. PATENT DOCUMENTS 3,871,557 A 3/1975 Smrt
3,972,038 A 7/1976 Fletcher et al.

(Continued)

FOREIGN PATENT DOCUMENTS

CA 2623761 10/2008
CA 2623466 6/2011

(Continued)

OTHER PUBLICATIONS

Bearden, T., "New Identification Technology Raises Concerns over Privacy," PBS Online NewsHour Report, Aug. 17, 2006, pp. 1-5, http:--www.pbs.org-newshour-bb-science-july-dec06-rfid_08-17.html.

(Continued)

*Primary Examiner* — Mark Hellner
(74) *Attorney, Agent, or Firm* — Foley & Lardner LLP; Joseph Teja, Jr.

(57) ABSTRACT

Marking devices for dispensing markers on the ground and marking methods are provided. The marking devices and marking methods use a marking dispenser having a machine-readable ID mechanism. The ID mechanism has data storage capability. In one embodiment, the marking dispenser may be provided with a radio-frequency identification (RFID) tag. In another embodiment, the marking dispenser may be provided with a barcode. The type of information that may be encoded in the ID mechanism may include, but is not limited to, product-specific information, user-specific information, other predetermined information of interest, and any combination thereof. The ID information encoded in the ID mechanism may be collected and used for various purposes, such as, but not limited to, real-time product verification, tracking which user location received a batch of marking paint, tracking marking paint inventory, tracking marking paint problems, and tracking marking paint usage.

22 Claims, 5 Drawing Sheets

U.S. PATENT DOCUMENTS

| | | | |
|---|---|---|---|
| 3,974,491 | A | 8/1976 | Sipe |
| 3,988,922 | A | 11/1976 | Clark et al. |
| 4,258,320 | A | 3/1981 | Schonstedt |
| 4,387,340 | A | 6/1983 | Peterman |
| 4,388,592 | A | 6/1983 | Schonstedt |
| 4,520,317 | A | 5/1985 | Peterman |
| 4,536,710 | A | 8/1985 | Dunham |
| 4,539,522 | A | 9/1985 | Schonstedt |
| 4,590,425 | A | 5/1986 | Schonstedt |
| 4,623,282 | A | 11/1986 | Allen |
| 4,639,674 | A | 1/1987 | Rippingale |
| 4,712,094 | A | 12/1987 | Bolson, Sr. |
| 4,747,207 | A | 5/1988 | Schonstedt et al. |
| 4,803,773 | A | 2/1989 | Schonstedt |
| 4,818,944 | A | 4/1989 | Rippingale |
| 4,839,623 | A | 6/1989 | Schonstedt et al. |
| 4,839,624 | A | 6/1989 | Schonstedt |
| 4,873,533 | A | 10/1989 | Oike |
| 4,899,293 | A | 2/1990 | Dawson et al. |
| 4,989,151 | A | 1/1991 | Nuimura |
| 5,001,430 | A | 3/1991 | Peterman et al. |
| 5,006,806 | A | 4/1991 | Rippingale et al. |
| 5,014,008 | A | 5/1991 | Flowerdew |
| 5,017,873 | A | 5/1991 | Rippingale et al. |
| 5,025,150 | A | 6/1991 | Oldham et al. |
| 5,043,666 | A | 8/1991 | Tavernetti et al. |
| 5,045,368 | A | 9/1991 | Cosman et al. |
| 5,065,098 | A | 11/1991 | Salsman et al. |
| 5,093,622 | A | 3/1992 | Balkman |
| 5,097,211 | A | 3/1992 | Schonstedt |
| 5,114,517 | A | 5/1992 | Rippingale et al. |
| 5,122,750 | A | 6/1992 | Rippingale et al. |
| 5,136,245 | A | 8/1992 | Schonstedt |
| 5,138,761 | A | 8/1992 | Schonstedt |
| 5,150,295 | A | 9/1992 | Mattingly |
| 5,173,139 | A | 12/1992 | Rippingale et al. |
| 5,206,065 | A | 4/1993 | Rippingale et al. |
| 5,214,757 | A | 5/1993 | Mauney et al. |
| 5,231,355 | A | 7/1993 | Rider et al. |
| 5,239,290 | A | 8/1993 | Schonstedt |
| 5,260,659 | A | 11/1993 | Flowerdew et al. |
| 5,264,795 | A | 11/1993 | Rider |
| 5,299,300 | A | 3/1994 | Femal |
| 5,329,464 | A | 7/1994 | Sumic et al. |
| 5,361,029 | A | 11/1994 | Rider et al. |
| 5,365,163 | A | 11/1994 | Satterwhite et al. |
| 5,373,298 | A | 12/1994 | Karouby |
| 5,379,045 | A | 1/1995 | Gilbert et al. |
| 5,381,338 | A | 1/1995 | Wysocki |
| 5,430,379 | A | 7/1995 | Parkinson et al. |
| 5,444,364 | A | 8/1995 | Satterwhite et al. |
| 5,467,271 | A | 11/1995 | Abel et al. |
| 5,471,143 | A | 11/1995 | Doany |
| 5,486,067 | A | 1/1996 | Huynh |
| 5,490,646 | A | 2/1996 | Shaw |
| 5,517,419 | A | 5/1996 | Lanckton |
| 5,519,329 | A | 5/1996 | Satterwhite |
| 5,529,433 | A | 6/1996 | Huynh |
| 5,530,357 | A | 6/1996 | Cosman et al. |
| 5,543,931 | A | 8/1996 | Lee et al. |
| 5,553,407 | A | 9/1996 | Stump |
| 5,568,162 | A | 10/1996 | Samsel et al. |
| 5,576,973 | A | 11/1996 | Haddy |
| 5,621,325 | A | 4/1997 | Draper et al. |
| 5,629,626 | A | 5/1997 | Russell et al. |
| 5,644,237 | A | 7/1997 | Eslambolchi et al. |
| 5,659,985 | A | 8/1997 | Stump |
| 5,673,050 | A | 9/1997 | Moussally et al. |
| 5,689,415 | A | 11/1997 | Calotychos et al. |
| 5,699,244 | A | 12/1997 | Clark, Jr. |
| 5,704,142 | A | 1/1998 | Stump |
| 5,739,785 | A | 4/1998 | Allison et al. |
| 5,751,289 | A | 5/1998 | Myers |
| 5,751,450 | A | 5/1998 | Robinson |
| 5,764,127 | A | 6/1998 | Hore et al. |
| 5,769,370 | A | 6/1998 | Ashjaee |
| 5,819,859 | A | 10/1998 | Stump et al. |
| 5,828,219 | A | 10/1998 | Hanlon et al. |
| 5,848,373 | A | 12/1998 | DeLorme et al. |
| 5,916,300 | A | 6/1999 | Kirk et al. |
| 5,917,325 | A | 6/1999 | Smith |
| 5,918,565 | A | 7/1999 | Casas |
| 5,920,194 | A | 7/1999 | Lewis et al. |
| 5,955,667 | A | 9/1999 | Fyfe |
| 6,026,135 | A | 2/2000 | McFee et al. |
| 6,031,454 | A | 2/2000 | Lovejoy et al. |
| 6,032,530 | A | 3/2000 | Hock |
| 6,037,010 | A | 3/2000 | Kahmann et al. |
| 6,053,260 | A | 4/2000 | Boon |
| 6,061,632 | A | 5/2000 | Dreier |
| 6,064,940 | A | 5/2000 | Rodgers |
| 6,074,693 | A | 6/2000 | Manning |
| 6,095,081 | A | 8/2000 | Gochenour |
| 6,107,801 | A | 8/2000 | Hopwood |
| 6,119,376 | A | 9/2000 | Stump |
| 6,127,827 | A | 10/2000 | Lewis |
| 6,130,539 | A | 10/2000 | Polak |
| 6,138,906 | A * | 10/2000 | DeMayo ..... 235/375 |
| 6,140,819 | A | 10/2000 | Peterman et al. |
| 6,169,958 | B1 | 1/2001 | Nagasamy et al. |
| 6,188,392 | B1 | 2/2001 | O'Connor et al. |
| 6,188,777 | B1 | 2/2001 | Darrell et al. |
| 6,206,282 | B1 | 3/2001 | Hayes, Sr. et al. |
| 6,234,218 | B1 | 5/2001 | Boers |
| 6,240,360 | B1 | 5/2001 | Phelan |
| 6,268,731 | B1 | 7/2001 | Hopwood et al. |
| 6,282,477 | B1 | 8/2001 | Gudat et al. |
| 6,285,911 | B1 | 9/2001 | Watts et al. |
| 6,292,108 | B1 | 9/2001 | Straser et al. |
| 6,294,022 | B1 | 9/2001 | Eslambolchi et al. |
| 6,297,736 | B1 | 10/2001 | Lewis et al. |
| 6,299,934 | B1 * | 10/2001 | Manning ..... 427/137 |
| 6,308,565 | B1 | 10/2001 | French et al. |
| 6,320,518 | B2 | 11/2001 | Saeki et al. |
| RE37,574 | E | 3/2002 | Rawlins |
| 6,356,082 | B1 | 3/2002 | Alkire et al. |
| 6,363,320 | B1 | 3/2002 | Chou |
| 6,375,038 | B1 | 4/2002 | Daansen et al. |
| 6,378,220 | B1 | 4/2002 | Baioff et al. |
| 6,388,629 | B1 | 5/2002 | Albats et al. |
| 6,390,336 | B1 | 5/2002 | Orozco |
| 6,401,051 | B1 | 6/2002 | Merriam |
| 6,407,550 | B1 | 6/2002 | Parakulam et al. |
| 6,411,094 | B1 | 6/2002 | Gard et al. |
| 6,437,708 | B1 | 8/2002 | Brouwer |
| 6,438,239 | B1 | 8/2002 | Kuechen |
| 6,459,266 | B1 | 10/2002 | Fling |
| 6,476,708 | B1 | 11/2002 | Johnson |
| 6,477,588 | B1 | 11/2002 | Yerazunis |
| 6,490,524 | B1 | 12/2002 | White et al. |
| 6,512,478 | B1 | 1/2003 | Chien |
| 6,526,400 | B1 | 2/2003 | Takata |
| 6,549,011 | B2 | 4/2003 | Flatt |
| 6,552,548 | B1 | 4/2003 | Lewis et al. |
| 6,585,133 | B1 | 7/2003 | Brouwer |
| 6,600,420 | B2 | 7/2003 | Goff et al. |
| 6,617,856 | B1 | 9/2003 | Royle et al. |
| 6,633,163 | B2 | 10/2003 | Fling |
| 6,650,293 | B1 | 11/2003 | Eslambolchi |
| 6,650,798 | B2 | 11/2003 | Russell et al. |
| 6,658,148 | B1 | 12/2003 | Fung |
| 6,674,276 | B2 | 1/2004 | Morgan et al. |
| 6,700,526 | B2 | 3/2004 | Witten |
| 6,710,741 | B2 | 3/2004 | Tucker |
| 6,717,392 | B2 | 4/2004 | Pearson |
| 6,723,375 | B2 | 4/2004 | Zeck et al. |
| 6,728,662 | B2 | 4/2004 | Frost et al. |
| 6,751,552 | B1 | 6/2004 | Minelli |
| 6,751,553 | B2 | 6/2004 | Young |
| 6,751,554 | B1 | 6/2004 | Asher et al. |
| 6,777,923 | B2 | 8/2004 | Pearson |
| 6,778,128 | B2 | 8/2004 | Tucker et al. |
| 6,798,379 | B2 | 9/2004 | Tucker et al. |
| 6,799,116 | B2 | 9/2004 | Robbins |
| 6,815,953 | B1 | 11/2004 | Bigelow |
| 6,819,109 | B2 | 11/2004 | Sowers et al. |
| 6,825,775 | B2 | 11/2004 | Fling et al. |

6,825,793 B2 11/2004 Taylor, Jr. et al.
6,833,795 B1 12/2004 Johnson et al.
6,833,811 B2 12/2004 Zeitfuss et al.
6,836,231 B2 12/2004 Pearson
6,845,171 B2 1/2005 Shum et al.
6,850,161 B1 2/2005 Elliott et al.
6,850,843 B2 2/2005 Smith et al.
6,853,303 B2 2/2005 Chen et al.
6,865,484 B2 3/2005 Miyasaka et al.
6,898,525 B1 5/2005 Minelli
6,898,550 B1 5/2005 Blackadar et al.
6,904,361 B1 6/2005 Tallman et al.
6,941,890 B1 9/2005 Cristo et al.
6,947,028 B2 9/2005 Shkolnikov
6,954,071 B2 10/2005 Flatt et al.
6,956,524 B2 10/2005 Tucker et al.
6,956,564 B1 10/2005 Williams
6,958,690 B1 10/2005 Asher et al.
6,968,296 B2 11/2005 Royle
6,972,698 B2 12/2005 Deguchi
6,975,942 B2 12/2005 Young et al.
6,977,508 B2 12/2005 Pearson et al.
6,992,584 B2 1/2006 Dooley et al.
6,993,088 B2 1/2006 Fling et al.
6,999,021 B2 2/2006 Taylor, Jr.
7,009,399 B2 3/2006 Olsson et al.
7,009,519 B2 3/2006 Leonard et al.
7,038,454 B2 5/2006 Gard et al.
7,042,358 B2 5/2006 Moore
7,048,320 B2 5/2006 Rubel
7,053,789 B2 5/2006 Fling et al.
7,057,383 B2 6/2006 Schlapp et al.
7,062,414 B2 6/2006 Waite et al.
7,079,591 B2 7/2006 Fling et al.
7,091,872 B1 8/2006 Bigelow et al.
7,113,124 B2 9/2006 Waite
7,116,244 B2 10/2006 Fling et al.
7,120,564 B2 10/2006 Pacey
7,235,980 B2 6/2007 Pearson et al.
7,285,958 B2 10/2007 Overby et al.
7,304,480 B1 12/2007 Pearson
7,310,584 B2 12/2007 Royle
7,319,387 B2 1/2008 Willson et al.
7,331,340 B2 2/2008 Barney
7,336,078 B1 2/2008 Merewether et al.
7,339,379 B2 3/2008 Thompson et al.
7,342,537 B2 3/2008 Pearson et al.
7,356,421 B2 4/2008 Gudmundsson et al.
7,358,738 B2 4/2008 Overby et al.
7,372,247 B1 * 5/2008 Giusti et al. ..... 324/67
7,372,276 B2 5/2008 Mulcahey
7,396,177 B2 7/2008 Lapstun et al.
7,396,178 B2 7/2008 Lapstun et al.
7,400,976 B2 7/2008 Young et al.
7,403,012 B2 7/2008 Worsley et al.
7,413,363 B2 8/2008 Lapstun et al.
7,443,154 B1 10/2008 Merewether et al.
7,451,721 B1 11/2008 Garza et al.
7,482,973 B2 1/2009 Tucker et al.
7,500,583 B1 3/2009 Cox
7,532,127 B2 5/2009 Holman et al.
7,636,901 B2 12/2009 Munson
7,640,105 B2 12/2009 Nielsen et al.
7,664,530 B2 2/2010 Skelton
7,733,077 B1 6/2010 Merewether et al.
7,773,095 B1 8/2010 Badrak et al.
7,834,801 B2 11/2010 Waite et al.
7,834,806 B2 11/2010 Tucker et al.
7,889,124 B2 2/2011 Islam et al.
7,889,888 B2 2/2011 Deardorr
7,929,981 B2 4/2011 Sangberg
7,978,129 B2 7/2011 Sawyer et al.
7,986,246 B2 7/2011 Angelis et al.
8,081,112 B2 12/2011 Tucker et al.
8,106,660 B1 1/2012 Merewether et al.
8,118,192 B2 2/2012 Daugherty
8,144,245 B2 3/2012 Vik
8,264,409 B2 9/2012 Miller
8,311,765 B2 11/2012 Nielsen et al.
2001/0029996 A1 10/2001 Robinson
2002/0035432 A1 3/2002 Kubica et al.
2002/0053608 A1 5/2002 Zeck et al.
2002/0103625 A1 8/2002 Card et al.
2002/0115472 A1 8/2002 Andress
2002/0122000 A1 9/2002 Bradley et al.
2002/0130806 A1 9/2002 Taylor et al.
2002/0130906 A1 9/2002 Miyaki
2003/0012411 A1 1/2003 Sjostrom
2003/0080897 A1 5/2003 Tranchina
2003/0100316 A1 5/2003 Odamura
2003/0135328 A1 7/2003 Burns et al.
2003/0168834 A1 9/2003 Ulrich
2003/0184300 A1 10/2003 Bigelow
2003/0196585 A1 10/2003 McDonald
2004/0006425 A1 1/2004 Wood
2004/0051368 A1 3/2004 Caputo
2004/0057795 A1 3/2004 Mayfield et al.
2004/0070535 A1 4/2004 Olsson et al.
2004/0124988 A1 7/2004 Leonard et al.
2004/0168358 A1 9/2004 Stump et al.
2004/0210370 A1 10/2004 Gudat
2004/0220731 A1 11/2004 Tucker
2004/0225444 A1 11/2004 Young et al.
2005/0023367 A1 2/2005 Reighard
2005/0034074 A1 2/2005 Munson
2005/0038825 A1 2/2005 Tarabzouni
2005/0040222 A1 2/2005 Robinson et al.
2005/0054457 A1 3/2005 Eyestone et al.
2005/0055142 A1 3/2005 McMurtry et al.
2005/0057745 A1 3/2005 Bontje
2005/0150399 A1 7/2005 Wiley
2005/0156600 A1 7/2005 Olsson
2005/0192727 A1 9/2005 Shostak et al.
2005/0206562 A1 9/2005 Willson et al.
2005/0232475 A1 10/2005 Floeder
2005/0278371 A1 12/2005 Funk et al.
2006/0026020 A1 2/2006 Waite et al.
2006/0055584 A1 3/2006 Waite et al.
2006/0077095 A1 4/2006 Tucker et al.
2006/0085133 A1 4/2006 Young
2006/0085396 A1 4/2006 Evans
2006/0109131 A1 5/2006 Sen et al.
2006/0169776 A1 8/2006 Hornbaker
2006/0220955 A1 10/2006 Hamilton
2006/0244454 A1 11/2006 Gard
2006/0254820 A1 11/2006 Gard et al.
2006/0262963 A1 11/2006 Navulur
2006/0276198 A1 12/2006 Michelon et al.
2006/0276985 A1 12/2006 Xu
2006/0282191 A1 12/2006 Gotfried
2006/0282280 A1 12/2006 Stotz et al.
2006/0285913 A1 12/2006 Koptis et al.
2006/0287900 A1 12/2006 Fiore
2006/0289679 A1 12/2006 Johnson et al.
2007/0013379 A1 1/2007 Staples et al.
2007/0018632 A1 1/2007 Royle et al.
2007/0031042 A1 2/2007 Simental
2007/0040558 A1 2/2007 Overby et al.
2007/0100496 A1 5/2007 Forell
2007/0219722 A1 9/2007 Sawyer, Jr.
2007/0223803 A1 9/2007 Shindo
2007/0268110 A1 11/2007 Little
2007/0286021 A1 12/2007 Hoenmans et al.
2007/0288195 A1 12/2007 Waite et al.
2008/0010009 A1 1/2008 Miyoshi
2008/0013940 A1 1/2008 Jung
2008/0125942 A1 5/2008 Tucker et al.
2008/0180322 A1 7/2008 Islam
2008/0204322 A1 8/2008 Oswald et al.
2008/0208415 A1 8/2008 Vik
2008/0228294 A1 9/2008 Nielsen et al.
2008/0245299 A1 10/2008 Nielsen et al.
2008/0255795 A1 10/2008 Shkolnikov
2008/0310721 A1 12/2008 Yang
2009/0004410 A1 1/2009 Thomson et al.
2009/0013928 A1 1/2009 Nielsen et al.
2009/0063258 A1 3/2009 Mueller et al.
2009/0085568 A1 4/2009 Cole et al.

2009/0109081 A1 4/2009 Ryerson
2009/0121933 A1 5/2009 Tucker
2009/0171616 A1 7/2009 Zhang et al.
2009/0185858 A1 7/2009 Malit
2009/0201178 A1 8/2009 Nielsen et al.
2009/0201311 A1 8/2009 Nielsen et al.
2009/0202101 A1 8/2009 Nielsen et al.
2009/0202110 A1 8/2009 Nielsen et al.
2009/0202111 A1 8/2009 Nielsen et al.
2009/0202112 A1 8/2009 Nielsen et al.
2009/0204238 A1 8/2009 Nielsen et al.
2009/0204466 A1 8/2009 Nielsen et al.
2009/0204614 A1 8/2009 Nielsen et al.
2009/0204625 A1 8/2009 Nielsen et al.
2009/0207019 A1 8/2009 Nielsen et al.
2009/0208642 A1 8/2009 Nielsen et al.
2009/0210098 A1 8/2009 Nielsen et al.
2009/0210245 A1 8/2009 Wold
2009/0210284 A1 8/2009 Nielsen et al.
2009/0210285 A1 8/2009 Nielsen et al.
2009/0210297 A1 8/2009 Nielsen et al.
2009/0210298 A1 8/2009 Nielsen et al.
2009/0237408 A1 9/2009 Nielsen et al.
2009/0238414 A1 9/2009 Nielsen et al.
2009/0238415 A1 9/2009 Nielsen et al.
2009/0238416 A1 9/2009 Nielsen et al.
2009/0238417 A1 9/2009 Nielsen et al.
2009/0241045 A1 9/2009 Nielsen et al.
2009/0241046 A1 9/2009 Nielsen et al.
2009/0327024 A1 12/2009 Nielsen et al.
2010/0006667 A1 1/2010 Nielsen et al.
2010/0010862 A1 1/2010 Nielsen et al.
2010/0010863 A1 1/2010 Nielsen et al.
2010/0010882 A1 1/2010 Nielsen et al.
2010/0010883 A1 1/2010 Nielsen et al.
2010/0045517 A1 2/2010 Tucker et al.
2010/0070347 A1 3/2010 Chen
2010/0084532 A1 4/2010 Nielsen et al.
2010/0085054 A1 4/2010 Nielsen et al.
2010/0085376 A1 4/2010 Nielsen et al.
2010/0085694 A1 4/2010 Nielsen et al.
2010/0085701 A1 4/2010 Nielsen et al.
2010/0086671 A1 4/2010 Nielsen et al.
2010/0086677 A1 4/2010 Nielsen et al.
2010/0088031 A1 4/2010 Nielsen et al.
2010/0088032 A1 4/2010 Nielsen et al.
2010/0088134 A1 4/2010 Nielsen et al.
2010/0088135 A1 4/2010 Nielsen et al.
2010/0088164 A1 4/2010 Nielsen et al.
2010/0090700 A1 4/2010 Nielsen et al.
2010/0090858 A1 4/2010 Nielsen et al.
2010/0094553 A1 4/2010 Nielsen et al.
2010/0097224 A1 4/2010 Prodanovich
2010/0117654 A1 5/2010 Nielsen et al.
2010/0131903 A1 5/2010 Thomson et al.
2010/0146454 A1 6/2010 Sugahara
2010/0161359 A1 6/2010 Asher
2010/0188088 A1 7/2010 Nielsen et al.
2010/0188215 A1 7/2010 Nielsen et al.
2010/0188216 A1 7/2010 Nielsen et al.
2010/0188245 A1 7/2010 Nielsen et al.
2010/0188407 A1 7/2010 Nielsen et al.
2010/0189312 A1 7/2010 Nielsen et al.
2010/0189887 A1 7/2010 Nielsen et al.
2010/0198663 A1 8/2010 Nielsen et al.
2010/0201690 A1 8/2010 Nielsen et al.
2010/0201706 A1 8/2010 Nielsen et al.
2010/0205031 A1 8/2010 Nielsen et al.
2010/0205032 A1 8/2010 Nielsen et al.
2010/0205195 A1 8/2010 Nielsen et al.
2010/0205264 A1 8/2010 Nielsen et al.
2010/0205536 A1 8/2010 Nielsen et al.
2010/0205554 A1 8/2010 Nielsen et al.
2010/0205555 A1 8/2010 Nielsen et al.
2010/0207816 A1 8/2010 Islam et al.
2010/0211354 A1 8/2010 Park et al.
2010/0228588 A1 9/2010 Nielsen et al.
2010/0245086 A1 9/2010 Nielsen et al.
2010/0247754 A1 9/2010 Nielsen et al.
2010/0253511 A1 10/2010 Nielsen et al.
2010/0253513 A1 10/2010 Nielsen et al.
2010/0253514 A1 10/2010 Nielsen et al.
2010/0255182 A1 10/2010 Nielsen et al.
2010/0256825 A1 10/2010 Nielsen et al.
2010/0256912 A1 10/2010 Nielsen et al.
2010/0256981 A1 10/2010 Nielsen et al.
2010/0257029 A1 10/2010 Nielsen et al.
2010/0257477 A1 10/2010 Nielsen et al.
2010/0259381 A1 10/2010 Nielsen et al.
2010/0259414 A1 10/2010 Nielsen et al.
2010/0262470 A1 10/2010 Nielsen et al.
2010/0262670 A1 10/2010 Nielsen et al.
2010/0263591 A1 10/2010 Nielsen et al.
2010/0268786 A1 10/2010 Nielsen et al.
2010/0272885 A1 10/2010 Olsson
2010/0285211 A1 11/2010 Nielsen et al.
2010/0318401 A1 12/2010 Nielsen et al.
2010/0318402 A1 12/2010 Nielsen et al.
2010/0318465 A1 12/2010 Nielsen et al.
2010/0324967 A1 12/2010 Nielsen et al.
2011/0006772 A1 1/2011 Olsson et al.
2011/0007076 A1 1/2011 Nielsen et al.
2011/0020776 A1 1/2011 Nielsen et al.
2011/0022433 A1 1/2011 Nielsen et al.
2011/0035245 A1 2/2011 Nielsen et al.
2011/0035251 A1 2/2011 Nielsen et al.
2011/0035252 A1 2/2011 Nielsen et al.
2011/0035260 A1 2/2011 Nielsen et al.
2011/0035324 A1 2/2011 Nielsen et al.
2011/0035328 A1 2/2011 Nielsen et al.
2011/0040589 A1 2/2011 Nielsen et al.
2011/0040590 A1 2/2011 Nielsen et al.
2011/0045175 A1 2/2011 Nielsen et al.
2011/0046993 A1 2/2011 Nielsen et al.
2011/0046994 A1 2/2011 Nielsen et al.
2011/0046999 A1 2/2011 Nielsen et al.
2011/0060496 A1 3/2011 Nielsen et al.
2011/0060549 A1 3/2011 Nielsen et al.
2011/0095885 A9 4/2011 Nielsen et al.
2011/0131081 A1 6/2011 Nielsen et al.
2011/0135163 A1 6/2011 Nielsen et al.
2011/0137769 A1 6/2011 Nielsen et al.
2011/0236588 A1 9/2011 Nielsen et al.
2011/0279229 A1 11/2011 Nielsen et al.
2011/0279230 A1 11/2011 Nielsen et al.
2011/0279476 A1 11/2011 Nielsen et al.
2011/0282542 A9 11/2011 Nielsen et al.
2011/0283217 A1 11/2011 Nielsen et al.
2011/0285749 A1 11/2011 Nielsen et al.
2012/0019380 A1 1/2012 Nielsen et al.
2012/0036140 A1 2/2012 Nielsen et al.
2012/0065924 A1 3/2012 Nielsen et al.
2012/0065944 A1 3/2012 Nielsen et al.
2012/0066137 A1 3/2012 Nielsen et al.
2012/0066273 A1 3/2012 Nielsen et al.
2012/0066506 A1 3/2012 Nielsen et al.
2012/0069178 A1 3/2012 Nielsen et al.
2012/0072035 A1 3/2012 Nielsen et al.
2012/0110019 A1 5/2012 Nielsen et al.
2012/0113244 A1 5/2012 Nielsen et al.
2012/0274476 A1 11/2012 Nielsen et al.

FOREIGN PATENT DOCUMENTS

CH 695087 A5 12/2005
EP 0636393 2/1995
EP 1521331 A2 4/2005
EP 1852365 A1 11/2007
EP 1974638 10/2008
GB 2266863 11/1993
JP 7256169 10/1994
JP 8285601 11/1996
JP 10060865 3/1998
JP 2000501666 2/2000
JP 2002079167 3/2002
WO WO-9112119 8/1991
WO WO-9424584 A1 10/1994
WO WO9516827 6/1995
WO WO-9629572 9/1996

| | | | |
|---|---|---|---|
| WO | WO-9854600 | A1 | 12/1998 |
| WO | WO-9854601 | A1 | 12/1998 |
| WO | WO-9900679 | A1 | 1/1999 |
| WO | WO0194016 | | 12/2001 |
| WO | WO-0228541 | | 4/2002 |
| WO | WO-2004100044 | A1 | 11/2004 |
| WO | WO-2004102242 | A1 | 11/2004 |
| WO | WO-2005052627 | A2 | 6/2005 |
| WO | WO-2006015310 | A3 | 2/2006 |
| WO | WO-2006136776 | A1 | 12/2006 |
| WO | WO-2006136777 | A1 | 12/2006 |
| WO | WO-2007067898 | A2 | 6/2007 |

OTHER PUBLICATIONS

Carey, B., "Tracking Shoes," Chicago Tribune Online Edition, Jan. 29, 2007; pp. 1-3; http:--www.chicagotribune.com-services-site-premium-access-registered.intercept.

Fox, G. et al., "GPS Provides Quick, Accurate Data for Underground Utility Location" (as featured in Apr. 2002 issue of Trenchless Technology, http:--ww.woolpert.com-asp-articles-GPS-Provides.asp, Sep. 14, 2007, pp. 1 and 2.

Trimble Navigation Limited, H-Star Technology Explained, www.trimble.com, pp. 1-9, 2005.

Co-pending U.S. Appl. No. 11/685,602, filed Mar. 13, 2007.

Co-pending U.S. Appl. No. 11/696,606, filed Apr. 4, 2007.

Co-pending U.S. Appl. No. 12/236,688, filed Sep. 24, 2008.

Co-pending U.S. Appl. No. 12/363,951, filed Feb. 2, 2009.

Co-pending U.S. Appl. No. 12/364,369, filed Feb. 2, 2009.

Co-pending U.S. Appl. No. 12/364,359, filed Feb. 2, 2009.

Co-pending U.S. Appl. No. 12/364,339, filed Feb. 2, 2009.

Office Action mailed Apr. 28, 2009 from Co-Pending U.S. Appl. No. 11/685,602.

International Search Report and Written Opinion, Application Serial No. PCT/US2009/005348, Mar. 2, 2010.

International Search Report and Written Opinion, Application Serial No. PCT/US2009/005359, Feb. 8, 2010.

Co-pending U.S. Appl. No. 12/539,497, filed Aug. 11, 2009.

Co-Pending U.S. Appl. No. 12/568,087 filed Sep. 28, 2009.

Co-pending U.S. Appl. No. 12/607,843, filed Oct. 28, 2009.

Co-pending U.S. Appl. No. 12/622,768, filed Nov. 20, 2009.

Co-pending U.S. Appl. No. 12/639,041, filed Dec. 16, 2009.

Co-pending U.S. Appl. No. 12/639,373 filed Dec. 16, 2009.

International Search Report and Written Opinion, Application Serial No. PCT/US2008/55796, Oct. 14, 2008.

International Search Report and Written Opinion, Application Serial No. PCT/US2008/55798, Jul. 28, 2008.

International Search Report and Written Opinion, Application Serial No. PCT/US2009/005299, Dec. 12, 2009.

Notice of Allowance dated Nov. 6, 2009 from Co-Pending U.S. Appl. No. 11/685,602.

Office Action dated Nov. 18, 2009 from Co-Pending Canadian Application No. 2,623,466, filed Mar. 4, 2008.

Office Action dated Nov. 23, 2009 from Co-Pending Canadian Application No. 2,623,761, filed Mar. 4, 2008.

Office Action dated Sep. 17, 2009 from Co-Pending U.S. Appl. No. 11/685,602.

U.S. Appl. No. 12/429,947, filed Apr. 24, 2009, Nielsen et al.

U.S. Appl. No. 12/571,411, filed Sep. 30, 2009, Nielsen et al.

U.S. Appl. No. 12/571,408, filed Sep. 30, 2009, Nielsen et al.

U.S. Appl. No. 12/571,401, filed Sep. 30, 2009, Nielsen et al.

U.S. Appl. No. 12/701,496, filed Feb. 5, 2010, Nielsen et al.

U.S. Appl. No. 12/701,468, filed Feb. 5, 2010, Nielsen et al.

U.S. Appl. No. 12/701,447, filed Feb. 5, 2010, Nielsen et al.

U.S. Appl. No. 12/703,958, filed Feb. 11, 2010, Nielsen et al.

U.S. Appl. No. 12/797,169, filed Jun. 9, 2010, Nielsen et al.

U.S. Appl. No. 12/797,202, filed Jun. 9, 2010, Nielsen et al.

U.S. Appl. No. 12/797,211, filed Jun. 9, 2010, Nielsen et al.

U.S. Appl. No. 12/797,227, filed Jun. 9, 2010, Nielsen et al.

U.S. Appl. No. 12/797,243, filed Jun. 9, 2010, Nielsen et al.

U.S. Appl. No. 12/797,262, filed Jun. 9, 2010, Nielsen et al.

U.S. Appl. No. 12/764,164, filed Apr. 21, 2010, Nielsen et al.

U.S. Appl. No. 12/855,977, filed Aug. 13, 2010, Nielsen et al.

U.S. Appl. No. 12/859,394, filed Aug. 19, 2010, Nielsen et al.

U.S. Appl. No. 12/786,929, filed May 25, 2010, Nielsen et al.

U.S. Appl. No. 12/854,370, filed Aug. 11, 2010, Nielsen et al.

Bernold, L.. et al. "Equipment operator training in the age of internet2," Proceedings of 19th International Symposium on Automation and Robotics in Construction (ISARC 2002), Sep. 2002 [retrieved on Nov. 12, 2010]. Retrieved from the Internet: <URL: http://fire.nist.gov/bfrlpubsibuild02IPDF/b02059.pdf>. p. 4, col. 2, para 2.

European Search Report, Application No. 08743671.3, Nov. 16, 2011.

European Search Report, Application No. 08743673.9, Feb. 28, 2011.

GPS Technology Enhancing Underground Utility Locating, Underground Construction Magazine, Apr. 7, 2010, 4 pages, http://www.undergroundconstructionmagazine.com/print/1034?page=show.

International Search Report and Written Opinion, Application No. PCT/2010/000389, Jun. 2, 2010.

International Search Report and Written Opinion, Application No. PCT/US10/45161, Oct. 29, 2010.

International Search Report and Written Opinion, Application No. PCT/US10/45409, Nov. 18, 2010.

International Search Report and Written Opinion, Application No. PCT/US10/45969, Nov. 18, 2010.

International Search Report and Written Opinion, Application No. PCT/US2009/003957, Mar. 21, 2011.

International Search Report and Written Opinion, Application No. PCT/US2010/036029, Sep. 3, 2010.

International Search Report and Written Opinion, Application No. PCT/US2011/047807, Dec. 6, 2011.

Jung, H.G., Structure Analysis Based Parking Slot Marking Recognition for Semi-automatic Parking System, Springer-Verlag Berlin Heidelberg 2006, 10 pages.

Notice of Allowance dated Jan. 24, 2012 from U.S. Appl. No. 12/363,951.

Notice of Allowance dated Aug. 25, 2011 from U.S. Appl. No. 11/696,606.

Notice of Allowance dated Apr. 28, 2011 from U.S. Appl. No. 29/356,631.

Notice of Allowance dated Jan. 25, 2012 from Canadian Application No. 2,710,189.

Notice of Allowance dated Nov. 12, 2010 from U.S. Appl. No. 29/356,242.

Notice of Allowance dated Nov. 12, 2010 from U.S. Appl. No. 29/356,633.

Notice of Allowance dated Nov. 12, 2010 from U.S. Appl. No. 29/356,635.

Notice of Allowance dated Nov. 28, 2011 from Canadian Application No. 2,710,269.

Office Action dated Jan. 12, 2012 from U.S. Appl. No. 12/364,369.

Office Action dated Jan. 25, 2012 from U.S. Appl. No. 12/568,087.

Office Action dated Feb. 1, 2011 from Canadian Application No. 2,691,707.

Office Action dated Feb. 9, 2012 from U.S. Appl. No. 12/364,339.

Office Action dated Feb. 28, 2012 from U.S. Appl. No. 12/539,497.

Office Action dated Mar. 2, 2012 from U.S. Appl. No. 12/639,041.

Office Action dated May 24, 2011 from U.S. Appl. No. 12/363,951.

Office Action dated Jun. 16, 2010 from Canadian Application No. 2,691,707.

Office Action dated Sep. 26, 2011 from Canadian Application No. 2,739,119.

Office Action dated Sep. 26, 2011 from Canadian Application No. 2,739,320.

Office Action dated Oct. 4, 2011 from U.S. Appl. No. 12/364,359.

Office Action dated Oct. 20, 2011 from U.S. Appl. No. 12/639,041.

Office Action dated Oct. 24, 2011 from U.S. Appl. No. 12/236,688.

Office Action dated Nov. 15, 2011 from Canadian Application No. 2,691,707.

Office Action dated Dec. 30, 2011 from U.S. Appl. No. 12/701,447.

Office Action dated Jul. 20, 2010 from U.S. Appl. No. 11/696,606.

Office Action dated Jul. 11, 2011 from Canadian Application No. 2713282.

Office Action dated Jun. 28, 2011 from Canadian Application No. 2710269.

Office Action dated Mar. 3, 2011 from Australian Application No. 2008226627.
Office Action dated Mar. 9, 2011 from Australian Application No. 2008236526.
Office Action dated Oct. 6, 2010 from Canadian Application No. 2623761.
Product Data, Hard Hat Aerosols Marking Paint 2300; Rust-oleum Netherlands B.V., Apr. 2005, 1 page, http://www.rustoleum.co.uk/downloads/2300%20Marking%20Spray.pdf.
Product Data, "Inverted Marking Chalk," Rust-oleum, Jul. 2004, 2 pages, http://www.policeone.com/pdfs/markingchalkinfo_ro.pdf.
VIRGINIA Underground utility marking standard, Mar. 2004, 20 pages.
U.S. Appl. No. 13/686,262, filed Nov. 27, 2012, Nielsen et al.
U.S. Appl. No. 13/644,226, filed Oct. 3, 2012, Nielsen et al.
Notice of Allowance dated Aug. 1, 2012 from U.S. Appl. No. 12/364,339.
Office Action dated Aug. 15, 2012 from Australian Application No. 2010214104.
Office Action dated Aug. 29, 2012 from U.S. Appl. No. 12/701,447.
Office Action dated Sep. 4, 2012 from U.S. Appl. No. 12/622,768.
Notice of Allowance dated Sep. 5, 2012 from U.S. Appl. No. 12/854,370.
3M Dynatel, Brochure, 2006, 1-4.
3M Dynatel, Locating and Marking System, Brochure, 2007, 1-16.
Office Action dated Sep. 21, 2012 from U.S. Appl. No. 12/797,202.
Office Action dated Sep. 25, 2012 from Australian Application No. 2010214053.
Notice of Allowance dated Oct. 1, 2012 from U.S. Appl. No. 12/607,843.
Office Action dated Oct. 2, 2012 from Japanese Application No. 2010-502170.
Office Action dated Oct. 15, 2012 from U.S. Appl. No. 12/797,227.
Notice of Allowance dated Oct. 17, 2012 from U.S. Appl. No. 12/236,688.
Office Action dated Oct. 19, 2012 from U.S. Appl. No. 12/797,243.
Olsson, Office Action dated Sep. 13, 2012 from U.S. Appl. No. 12/827,993.
Notice of Allowance dated Oct. 25, 2012 from U.S. Appl. No. 12/639,373.
Notice of Allowance dated Nov. 7, 2012 from U.S. Appl. No. 12/639,041.
Office Action dated Nov. 14, 2012 from Canadian Application No. 2,750,908.
Office Action dated Nov. 20, 2012 from U.S. Appl. No. 12/701,468.
Office Action dated Nov. 21, 2012 from U.S. Appl. No. 12/701,496.
Office Action dated Nov. 23, 2012 from U.S. Appl. No. 12/855,977.
Office Action dated Nov. 26, 2012 from U.S. Appl. No. 12/764,164.
Office Action dated Dec. 5, 2012 from U.S. Appl. No. 12/797,262.
Notice of Allowance dated Dec. 12, 2012 from U.S. Appl. No. 12/703,958.
Office Action dated Dec. 18, 2012 from U.S. Appl. No. 12/786,929.
Office Action dated Dec. 20, 2012 from U.S. Appl. No. 12/571,408.
Notice of Allowance dated Dec. 21, 2012 from U.S. Appl. No. 12/364,339.
Office Action dated Jul. 26, 2012 from U.S. Appl. No. 12/639,041.
Office Action dated Jul. 27, 2012 from European Application No. 08743671.3.
New Mexico's Recommended Marking Guidelines for Underground Utilities, May 2006, 8 pages.
Office Action dated Mar. 20, 2012 from U.S. Appl. No. 12/764,164.
Office Action dated Mar. 29, 2012 from GB Application No. 1107052.1.
Office Action dated Apr. 10, 2012 from U.S. Appl. No. 12/854,370.
Office Action dated Apr. 12, 2012 from Canadian Application No. 2,691,707.
Office Action dated Apr. 13, 2012 from Australian Application No. 2008236526.
Office Action dated Apr. 17, 2012 from U.S. Appl. No. 12/607,843.
Office Action dated Apr. 25, 2012 from U.S. Appl. No. 12/363,046.
Notice of Allowance dated Mar. 9, 2012 from U.S. Appl. No. 12/236,688.
Office Action dated Mar. 13, 2012 from U.S. Appl. No. 12/364,359.
Luczak, S., "Increasing Accuracy of Tilt Measurements," Engineering Mechanics, vol. 14, 2007, p. 143-154.
Notice of Allowance dated Jul. 12, 2012 from U.S. Appl. No. 12/539,497.
Office Action dated May 1, 2012 from Australian Application No. 2009300362.
Office Action dated May 15, 2012 from U.S. Appl. No. 12/797,243.
Office Action dated May 17, 2012 from U.S. Appl. No. 12/364,369.
Office Action dated Jun. 1, 2012 from U.S. Appl. No. 12/855,977.
Office Action dated Jun. 4, 2012 from U.S. Appl. No. 12/568,087.
Office Action dated Jun. 4, 2012 from U.S. Appl. No. 12/703,958.
Office Action dated Jun. 8, 2012 from U.S. Appl. No. 12/639,041.
Office Action dated Jun. 13, 2012 from U.S. Appl. No. 12/639,373.
Office Action dated Jun. 8, 2012 from U.S. Appl. No. 12/701,468.
Office Action dated Jun. 18, 2012 from U.S. Appl. No. 12/701,496.
Office Action dated Jul. 2, 2012 from U.S. Appl. No. 12/797,262.
Office Action dated Jul. 12, 2012 from U.S. Appl. No. 12/571,411.
Notice of Allowance dated Jan. 8, 2013 from U.S. Appl. No. 12/797,243.
Notice of Allowance dated Jan. 22, 2013 from U.S. Appl. No. 12/703,958.
U.S. Appl. No. 13/795,337, filed Mar. 12, 2013, Nielsen et al.
U.S. Appl. No. 13/797,229, filed Mar. 12, 2013, Nielsen et al.
U.S. Appl. No. 13/751,862, filed Jan. 28, 2013, Nielsen et al.
U.S. Appl. No. 13/846,120, filed Mar. 18, 2013, Nielsen et al.
Notice of Allowance dated Feb. 1, 2013 from U.S. Appl. No. 12/797,202.
Notice of Allowance dated Feb. 13, 2013 from U.S. Appl. No. 12/701,447.
Notice of Allowance dated Feb. 20, 2013 from U.S. Appl. No. 12/364,369.
Notice of Allowance from U.S. Appl. No. 12/622,768 dated Jan. 24, 2013.
Office Action dated Jan. 9, 2013 from U.S. Appl. No. 12/571,411.
Office Action received Jan. 18, 2013 from Japanese Application No. 2009-553688.
Corrected Notice of Allowability from U.S. Appl. No. 12/364,369 dated Apr. 15, 2013.
Corrected Notice of Allowability from U.S. Appl. No. 12/703,958 dated Apr. 18, 2013.
Office Action dated Mar. 13, 2013 from Chinese Application No. 201080045879.1.
Notice of Alowance daed Apr. 25, 2013 from U.S. Appl. No. 12/364,359.

* cited by examiner

MARKING APPARATUS AND MARKING METHODS USING MARKING DISPENSER WITH MACHINE-READABLE ID MECHANISM

CROSS REFERENCE TO RELATED APPLICATION

This application claims a priority benefit, under 35 U.S.C. §119(e), to Provisional Application Ser. No. 61/075,882, filed Jun. 26, 2008, which is hereby incorporated by reference in its entirety. This application also claims the benefit, under 35 U.S.C. §120, as a continuation-in-part (CIP) of the following U.S. non-provisional applications: Ser. No. 11/696,606, filed Apr. 4, 2007, entitled "Marking System and Method," and Ser. No. 11/685,602, filed Mar. 13, 2007, entitled "Marking System and Method with Location and/or Time Tracking."

FIELD OF THE INVENTION

The present invention relates generally to the field of marking devices for placing marks on the ground. In particular, the present invention relates to marking devices and marking methods using marking dispensers each having a machine-readable ID mechanism affixed thereto.

BACKGROUND

Marking paint, such as inverted marking spray paint (also known as "upside down paint"), may be used by land surveyors, utility location experts, or anyone that has a need to mark a location on the ground. Marking paint may be used along with paint marking wands and/or paint marking wheels, which provide a convenient method of dispensing the marking paint onto the ground.

In many marking applications, a specified marking paint color may be required for identifying a certain entity. For example, once located, an underground power line may be marked with one color, an underground telephone line may be marked with another color, an underground gas line may be marked with yet another color, and so on. Further, the attributes of marking paint may be important for providing durability and/or ease of removal characteristics. Consequently, the marking paint formulations may vary according to durability and/or ease of removal specifications for different surfaces and uses. For example, municipalities may require that marking paint on streets and sidewalks fade away after only a few days. Therefore, it may be beneficial to develop mechanisms for ensuring, for example, that the proper color and/or formulation of marking paint is being used and/or has been used.

Additionally, in the marking industry, the aggregate cost of the marking paint for marking multiple locations may be substantial. However, while substantial in the aggregate, individual dispensers of marking paint are relatively inexpensive. Accordingly, the consumption of marking paint is hard to track and/or control as the cost of individual dispensers is generally thought of as insignificant by the marking technicians who, therefore, tend to be wasteful. For example, marking paint dispensers are often discarded before being completely emptied. Consequently, over time a significant amount of useful marking paint may be wasted, and, in addition to environmental concerns, the cost of supplying and/or replenishing the marking paint is not optimized.

Accordingly, approaches are needed for easily determining the type of marking paint that is being used in, for example, an underground facility locate operation and for monitoring the consumption of marking paint in the marking industry.

SUMMARY OF THE INVENTION

According to a first aspect of the invention, a marking apparatus is provided to mark the presence or absence of an underground facility in a dig area. The marking apparatus comprises a housing configured to enable dispensing of a marker onto the ground for marking the presence or absence of an underground facility in a dig area; a marking dispenser holder affixed to the housing to hold at least one marking dispenser; an actuator to cause dispensing of the marker from the marking dispenser onto the ground in the dig area, in a marking operation, to mark presence or absence of an underground facility; at least one reader device to read ID information from an ID mechanism affixed to the marking dispenser; and a processing device to generate marker information in response to the ID information received from the reader device, the marker information representing at least one characteristic of the marking substance.

According to a second aspect of the invention, a method is provided for performing a marking operation for marking the presence or absence of an underground facility in a dig area using a marking apparatus that holds at least one marking dispenser. The method comprises dispensing a marker from the marking dispenser onto the ground in the dig area, in a marking operation, to mark the presence or absence of an underground facility, in response to activation of the marking dispenser; reading ID information from an ID mechanism affixed to the marking dispenser; and generating marker information in response to the ID information read from the ID mechanism.

BRIEF DESCRIPTION OF THE DRAWINGS

For the purpose of illustrating the present invention, the drawings show aspects of one or more embodiments of the present invention. However, it should be understood that the present invention is not limited to the precise arrangements and instrumentalities shown in the drawings, wherein.

DETAILED DESCRIPTION

The invention relates to marking devices for dispensing markers on the ground and to marking methods. The marking devices and marking methods use a marking dispenser having a machine-readable ID mechanism affixed thereto. The ID mechanism of the marking dispenser has data storage capability. In one embodiment of the present invention, the marking dispenser may be provided with a radio-frequency identification (RFID) tag. In another embodiment of the present invention, the marking dispenser may be provided with a barcode. The type of information that may be encoded in the ID mechanism of the marking dispenser may include, but is not limited to, product-specific information, user-specific information, other predetermined information of interest, and any combination thereof. The ID information encoded in the ID mechanism may be collected and used for various purposes, such as, but not limited to, real-time product verification, tracking which user location received a batch of marking paint, tracking marking paint inventory, tracking marking paint problems, and tracking marking paint usage.

Figure 1:
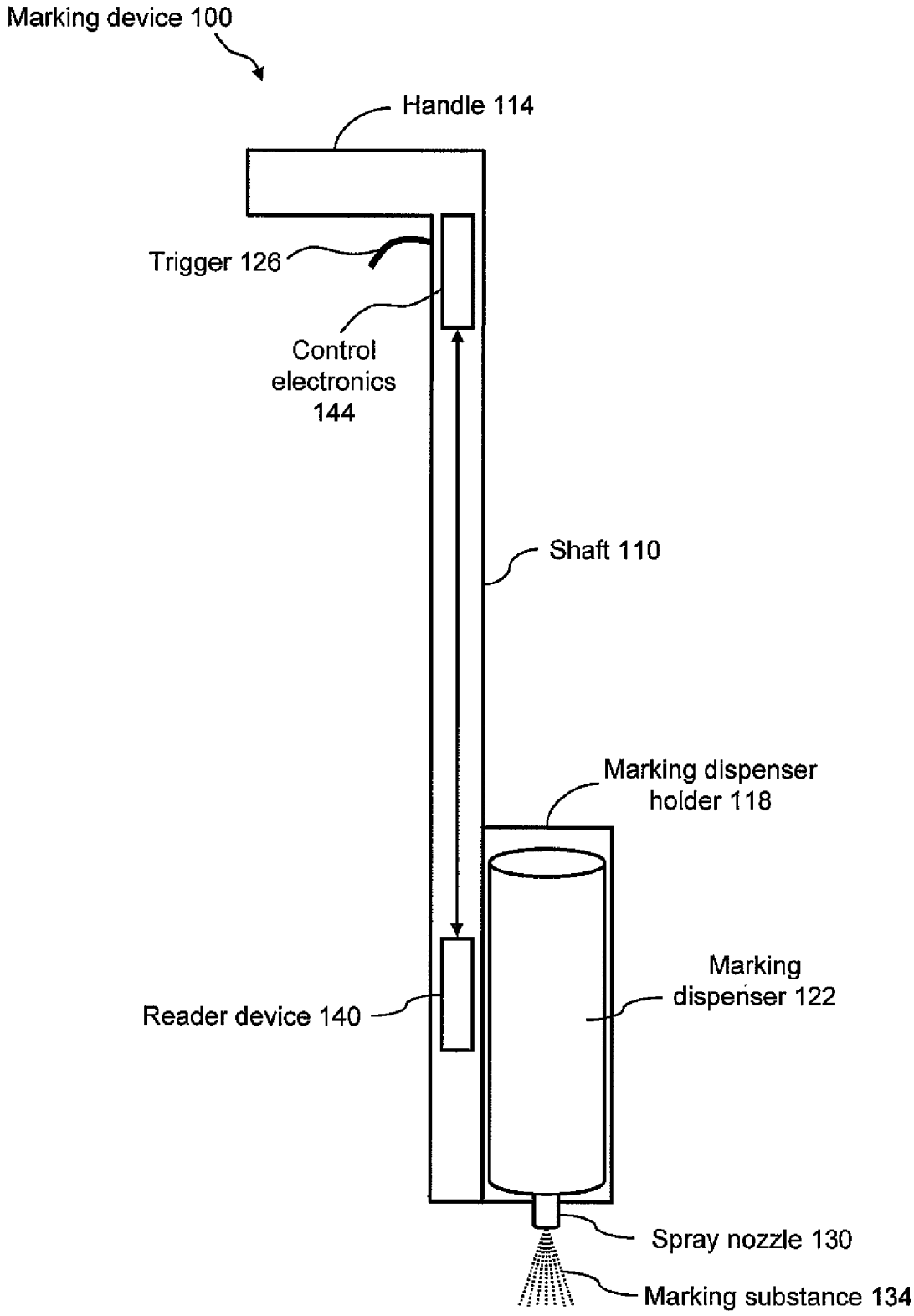
FIG. 1 is a schematic representation of a marking device for use with a marking dispenser having a machine-readable ID mechanism.

FIG. 1 is a schematic representation of a marking device 100, also referred to herein as a "marking apparatus", that includes at least one reader device for reading an ID mechanism on a marking dispenser. Marking device 100 may include a shaft 110, handle 114 at one end of shaft 110 and a marking dispenser holder 118 for holding a marking dispenser 122 at the end of shaft 110 that is opposite handle 114. Additionally, marking device 100 may include a trigger 126 for actuating a spray nozzle 130 of marking dispenser 122 to dispense a marking substance 134 onto the target of a marking operation, such as the ground. Marking dispenser 122 may be an aerosol canister that contains a quantity of a marking substance 134. Marking substance 134 may be, for example, marking paint, marking chalk, marking dye, marking powder, and the like. In one example, marking dispenser may be an aerosol canister that contains marking paint, such as commercially available marking paint. Marking device 100 may be configured to hold a single marking dispenser or more than one marking dispenser.

A basic marking operation of marking device 100 may be described as follows. A user, such as a locate technician in an underground facility locate application, loads a marking dispenser 122 that contains a quantity of marking substance 134 into marking dispenser holder 118. The user grasps handle 114 of marking device 100 and aims nozzle 130 of marking dispenser 122 at the intended target. The user then pulls trigger 126, which may be mechanically and/or electrically coupled to spray nozzle 130 of marking dispenser 122 in order to dispense marking substance 134 in a specified pattern on the intended target, such as the ground. For example, marking device 100 may be used to mark lines, arrows, geometric shapes, numbers, letters, words, and combinations thereof on the ground.

Marking device 100 further includes at least one reader device 140 and control electronics 144, as described below. In some embodiments, marking device 100 is configured for mounting a single marking dispenser and includes at least one reader device. In other embodiments, marking device 100 is configured for mounting one or more marking dispensers and includes one or more reader devices for each marking dispenser. In further embodiments, marking device 100 includes two or more reader devices of the same or different types.

Marking dispenser 122 includes an ID mechanism 124 integrated therein or thereon. Marking dispenser 122 may be any canister for containing and dispensing a quantity of marking substance, such as marking paint or chalk. For example, marking dispenser 122 may be a standard aerosol canister that contains a quantity of the marking substance, such as, for example, commercially available marking paint.

ID mechanism 124 may be, for example, a passive data storage mechanism that contains encoded information which is machine-readable via reader device 140. In one example, ID mechanism 124 may be an RFID tag device that stores information which may be read by an RFID reader. In another example, ID mechanism 124 may be one or more barcodes that store information which may be read by a barcode reader. The type of information that may be encoded in ID mechanism 124 may include, but is not limited to, product-specific information (e.g., manufacturer, brand, product code, lot or batch number, production date, paint color, paint formulation, and the like), user-specific information (e.g., office location of using company), other predetermined information of interest, and any combination thereof. More details of the marking dispenser 122 having ID mechanism 124 are described with reference to FIGS. 2 and 4.

Figure 2:
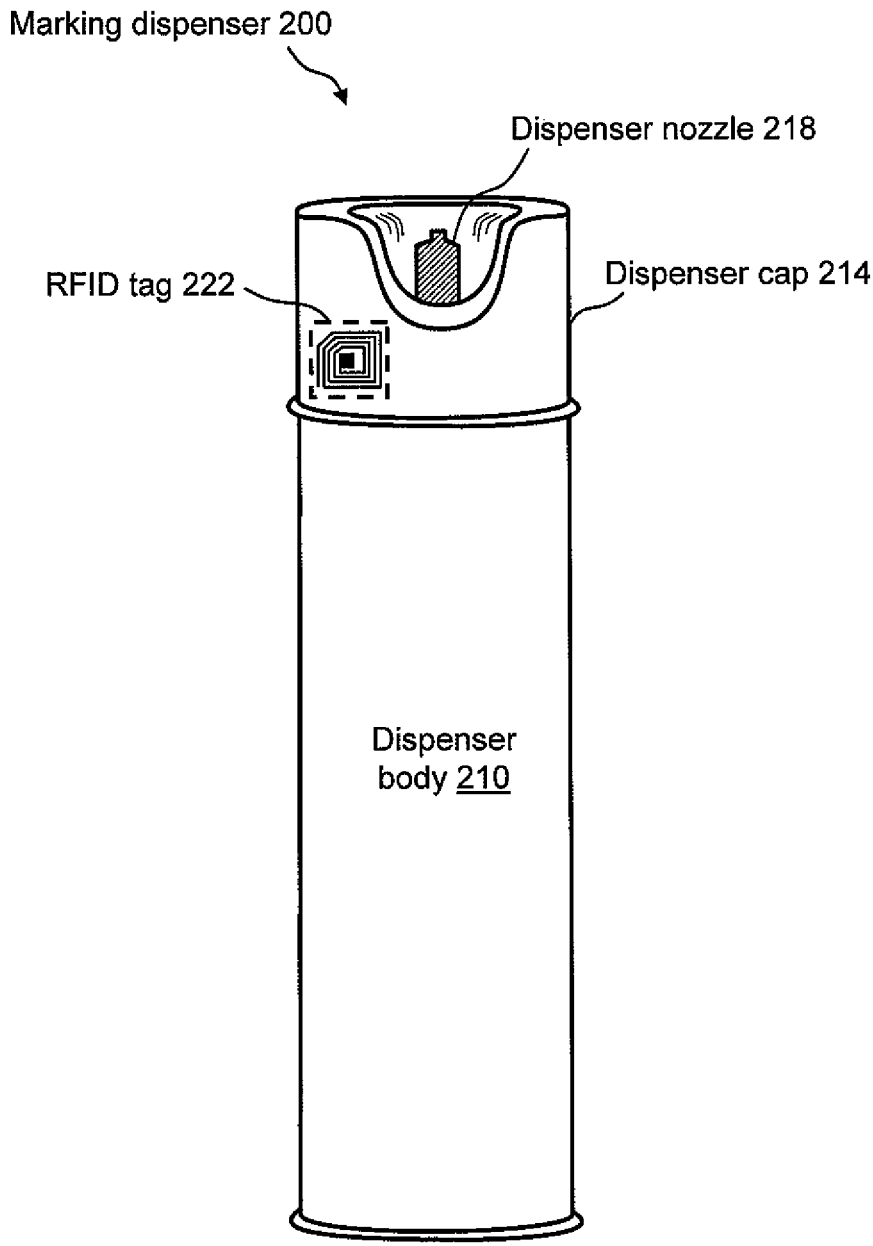
FIG. 2 is a front view of a marking dispenser having an RFID tag.

FIG. 2 is a front view of a marking dispenser 200 having an RFID tag 222, which is one embodiment of marking dispenser 122. In this embodiment, marking dispenser 200 may include a dispenser body 210, which may be, for example, a metal aerosol canister for holding a quantity of marking paint, a dispenser cap 214, which may be a plastic cap that is mounted on dispenser body 210, and a dispenser nozzle 218 that is integrated into dispenser cap 214. Dispenser nozzle 218 is the mechanism through which the marking substance is dispensed from within dispenser body 210 via the action of, for example, aerosol propellant. The combination of dispenser body 210, dispenser cap 214, and dispenser nozzle 218 may be of the type commercially available for use as marking paint.

RFID tag 222 is integrated with dispenser cap 214 of marking dispenser 200. RFID tag 222 may be a RFID tag device, which may be a microchip (not shown) that is combined with an antenna (not shown) in a compact package that is structured to allow the RFID tag to be attached to an object. The antenna of the RFID tag receives signals from an RFID reader or scanner (not shown) and then transmits a signal containing the data of interest. In one example, RFID tag 222 may be a Generation 2 passive RFID tag that is weather resistant and dual-sided in order to reduce the read range.

Preferably, RFID tag 222 is attached to the inside of dispenser cap 214, in order to provide a tamper-resistant and weather-resistant package. Dispenser cap 214 may be formed of any material that is suitable for use with RFID technology. In one example, dispenser cap 214 may be formed of durable molded plastic.

The location of RFID tag 222 in marking dispenser 200 is not limited to the inside of dispenser cap 214. RFID tag 222 may be attached to any location on marking dispenser 200 where the transmit/receive functionality of RFID tag 222 is ensured. For example, RFID tag 222 may be attached to the outside of dispenser cap 214 or to the outside dispenser body 210.

In a typical paint marking device for marking on the ground, marking dispenser 200 may be installed upside down (i.e., dispenser cap 214-side down).

Figure 3:
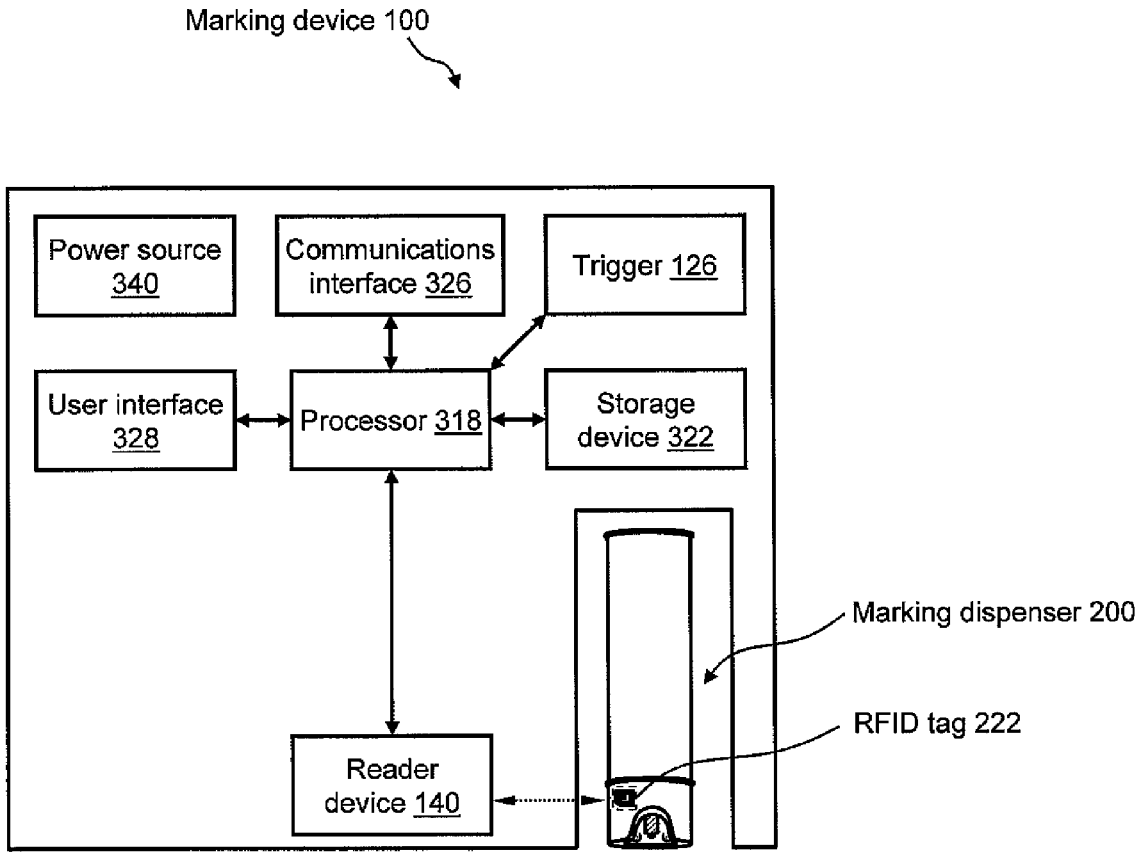
FIG. 3 is a functional block diagram of the marking device of FIG. 1.

FIG. 3 is a functional block diagram of an embodiment of marking device 100 of FIG. 1. As shown, marking dispenser 200 having RFID tag 222 thereon is installed in marking device 100. Marking device 100 may include reader device 140, a processor 318, a storage device 322, a communications interface 326, a user interface 328, a trigger 330 and a power source 340.

In the embodiment of FIG. 3, reader device 140 is an RFID reader or scanner device. In this embodiment, the antenna of RFID tag 222 receives signals from reader device 140 and then transmits a signal that has the data of interest encoded therein. The position of RFID tag 222 relative to the location of reader device 140 is important. In one embodiment, reader device 140 may be a low frequency reader, such as a frequency of about 1356 megahertz (MHz), and has a read range from about 6 inches to about 8 inches.

Processor 318 may be any general-purpose processor, controller, or microcontroller device that is capable of controlling reader device 140 and managing the data that is received from RFID tag 222 via reader device 140. In one example, the data that is returned from reader device 140 may be stored locally in storage device 322. Storage device 322 may be any volatile or nonvolatile data storage device, such as, but not limited to, a random access memory (RAM) device and a removable memory device (e.g., a universal serial bus ("USB") flash drive).

Communications interface 326 may be any wired and/or wireless interface by which data may be transmitted from marking device 100 to an external or remote device, such as a remote computing device. Example wired interfaces may include, but are not limited to, USB ports, RS232 connectors, RJ45 connectors, and any combination thereof. Example wireless interfaces may include, but are not limited to, Bluetooth® technology and IEEE 802.11 technology. Data stored in storage device 322 may be transmitted in real time or non-real time from marking device 100 via communications interface 326. Alternatively, data that is received from reader device 140 may be transmitted in real time via communications interface 326 with or without being stored locally in storage device 322.

User interface 328 may include any visual and/or audible device that can be used to provide information (depending on the type and function of ID mechanism 124) to the user of the marking device 100. For example, user interface 328 may include visual indicators, such as one or more light emitting diode (LED) devices and/or a display device, and one or more audible devices, such as a buzzer, a beeper, a speaker, and the like. The display device may include a display screen to display ID information read from ID mechanism 124 and/or marker information derived from the ID information. User interface 328 may also include one or more input devices, such as a touch screen or a keypad, to enable user input.

User interface 328 may include a set of visual indicators 328 which provide feedback to the user of the marking device 100. For example, visual indicators may provide immediate or substantially immediate feedback as to the color or any other characteristic of the marking paint in marking paint dispenser 200. For example, a light-emitting diode (LED) may be provided for each possible color of marking substance. The visual indicators may include red, orange, green, yellow, and blue LEDs. In one example, when marking dispenser 200 with RFID tag 222 is installed in marking device 100, reader device 140 scans RFID tag 222. Processor 318 processes the RFID data to determine the color of the marking substance in marking dispenser 200. Subsequently, processor 318 activates the LED that corresponds to the color of the marking substance that has been detected. In doing so, substantially immediate feedback is provided to the user of marking device 100. In this way, the user may verify, for example, that the intended color of marking substance has been installed. Alternatively, information based on the RFID data may be displayed on a display device.

Trigger 330 may be any mechanism by which a read operation of reader device 140 may be initiated. In one example, trigger 330 may be a program function that initiates a read of RFID tag 222 via reader device 140, such as a periodic read that is performed at set time intervals. In another example, trigger 330 may be an electronic trigger that occurs whenever the trigger 126 (FIG. 1) is pulled by the user to dispense the marking substance in marking dispenser 200. In this example, processor 318 passes this electronic trigger to reader device 140 anytime that the trigger of the wand is pulled.

The marking device 100 may be the marking device that is described in U.S. patent application Ser. No. 11/696,606, filed Apr. 4, 2007 and published Oct. 9, 2008 as Publication No. 2008/0245299, entitled "Marking system and method" and U.S. patent application Ser. No. 11/685,602, filed Mar. 13, 2007 and published Sep. 19, 2008 as Publication No. 2008/0228294, entitled "Marking system and method with location and/or time tracking," both of which are incorporated by reference herein in their entirety.

Figure 4:
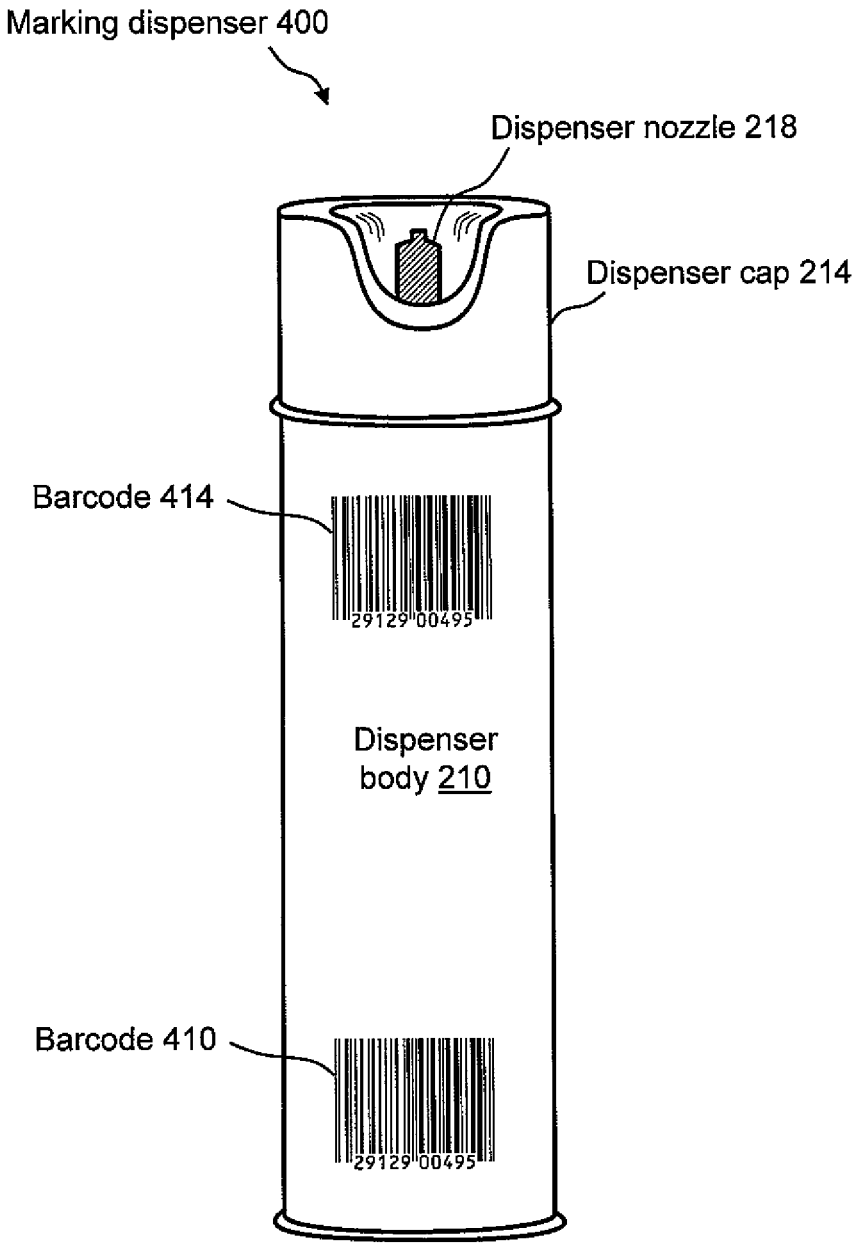
FIG. 4 is a front view of a marking dispenser having a barcode.

FIG. 4 is a front view of a marking dispenser 400 having at least one barcode, which is another embodiment of the marking dispenser 122. In this embodiment, marking dispenser 400 is substantially the same as the marking dispenser 200 of FIG. 2, except that RFID tag 222 is replaced with one or more barcodes. For example, a first barcode, such as a barcode 410, maybe the manufacturer-specific barcode provided by the manufacturer of the marking substance. Optionally, a second barcode, such as a barcode 414, may be provided that has additional information encoded therein, such as the user-specific information (e.g., office location of using company). Referring to FIG. 3, in the case of using marking dispenser 400 within marking device 100, reader device 140 may be a barcode reader or scanner.

Figure 5:
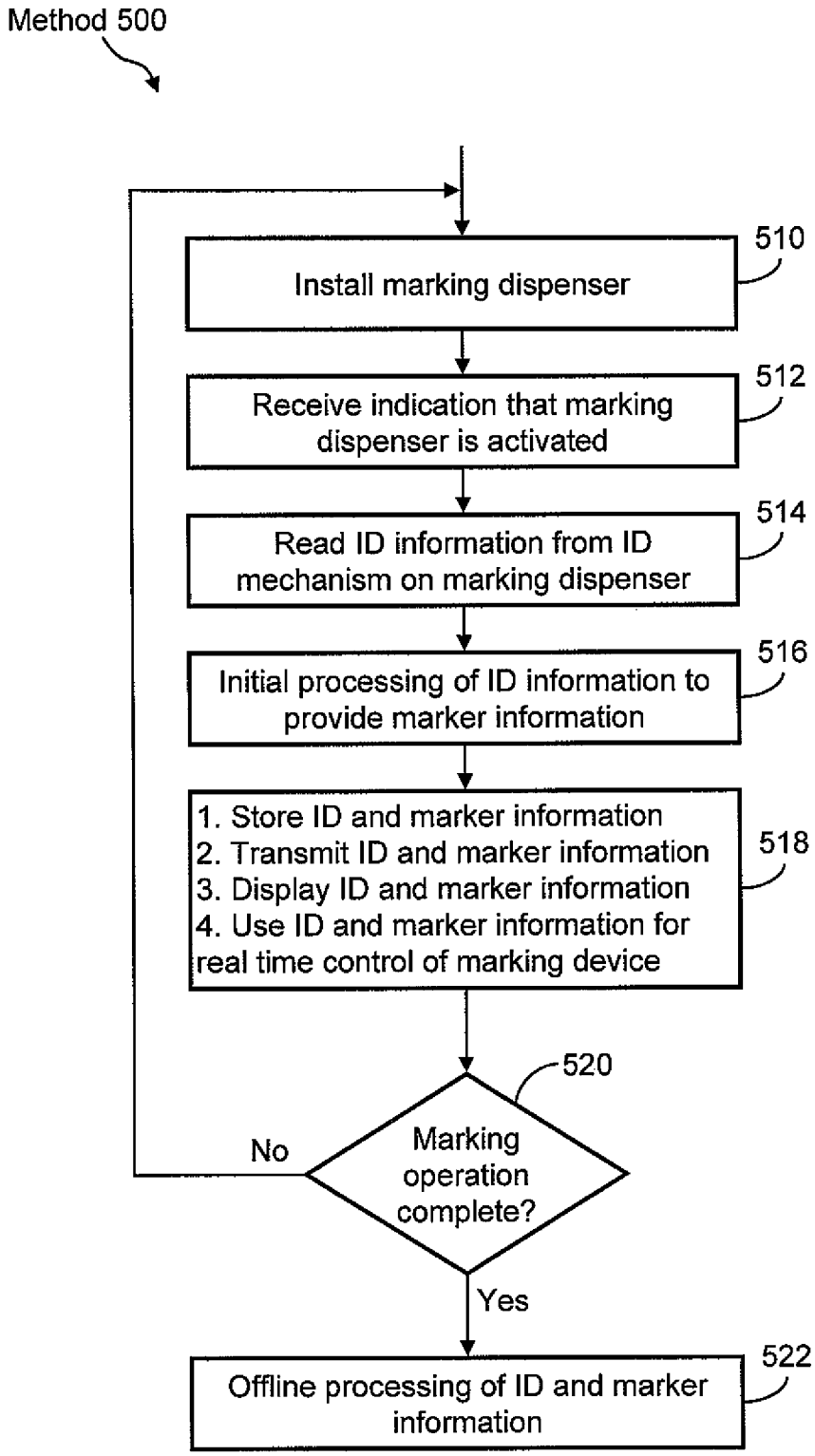
FIG. 5 is a flow diagram of a method of using a marking device having a machine-readable ID mechanism.

FIG. 5 is a flow diagram of a method 500 of operating marking device 100 using a marking dispenser having a machine-readable ID mechanism affixed thereto. The method 500 is described with reference to marking device 100 of FIGS. 1 and 3. Method 500 may include, but is not limited to, the following acts.

In act 510, marking dispenser 122 having machine-readable ID mechanism 124 is installed in the marking device 100. As described above, examples of the ID mechanism 124 include an RFID tag and a barcode.

In act 512, the trigger 126 of the marking device is pulled or otherwise activated by the user in order to dispense a quantity of marking substance 134 from the marking dispenser 122 onto the ground. The processor 318 receives an indication that the marking dispenser 122 has been activated to dispense marking substance 134.

In act 514, processor 318 causes reader device 140 to read ID information from the ID mechanism 124 on marking dispenser 122. For example, processor 318 may issue a command to reader device 140 to read ID information from ID mechanism 124 in response to the user activating the trigger 126 of the marking device 100 to dispense marking substance 134 onto the ground. For example, reader device 140 may scan RFID tag 222 (FIG. 2) or barcode 410 (FIG. 4). In other embodiments, the reader device 140 may be instructed to read the ID information from the ID mechanism 124 in response to one or more of a user query, power up of the marking device 100, a periodic signal, or installation of a marking dispenser in the marking device. The ID information read from ID mechanism 124 is supplied by reader device 140 to processor 318.

In act 516, processor 318 performs initial processing of the ID information read from the ID mechanism 124 to provide marker information. By way of example only, the ID information read from the ID mechanism may include a product code and a manufacturer code. The product code, the manufacturer code, or both, may be used to access corresponding product information stored in storage device 322. The stored product information may include marker information, such as for example, paint color, durability and intended application of the marking paint. In other embodiments, the ID information read from the ID mechanism 124 includes the desired marker information and does not require processing by processor 318. In this embodiment, the initial processing of act 516 may be optional. Thus, the ID information read from ID mechanism 124 may include information which requires initial processing by processor 318 to provide marker information and/or marker information read directly from ID mechanism 124.

In block 518, acts involving utilization of the ID information and/or the marker information are shown. The acts shown in block 518 may be performed separately or in any combination. The acts of block 518 may be performed or not performed, depending on the operating state of marking device 100 and on the application of marking device 100. Also, additional acts may involve the ID information and/or the marker information, or a selected subset thereof.

In act 518.1, the ID information and/or the marker information, or a selected subset thereof, is stored locally in storage device 322 of marking device 100. The ID information and/or the marker information can be stored separately or with other data in an electronic record of a marking operation or of operation of the marking device. The stored information, or a selected subset thereof, can be processed locally and/or transmitted to a remote device for processing, can be displayed on a display device and/or an indicator, and/or can be used for real-time control of the marking device, for example.

In act 518.2, the ID information and/or the marker information, or a selected subset thereof, is transmitted by communications interface 326 to a remote device. Examples of the remote device include i.e., a computer located in the vehicle of the user or a remote server, or both. Communications interface 326 may utilize wireless communication and/or a wired connection for transmission of the ID information and/or marker information. In one example of a wired connection, when the user returns to his/her home base, the marking device 100 may be connected by a wired connection to a central computing device. In particular, the marking device may be coupled to a docking station (not shown) that is designed to connect with communications interface 326. In doing so, the ID information and marker information that is stored locally within storage device 322 may be transmitted to the central computing device.

In act 518.3, the ID information and/or the marker information, or a selected subset thereof, may be displayed to the user, for example, on a display screen or via indicators. The ID and/or marker information may be for information only or may require an action by the user, such as verifying that the ID information and/or the marker information indicates that the marking dispenser is appropriate for the intended application. The display of ID information and/or marker information provides feedback to the user and permits verification that the intended marking dispenser 122 has been installed.

In act 518.4, the ID information and/or the marker information, or a selected subset thereof, is used for real-time control of the marking device 100. Thus, for example, selected ID information and/or marker information may be compared with reference information, for example, entered by the user. In the absence of a match, dispensing of the marking substance 134 from the marking dispenser 122 may be inhibited automatically. Other real-time control applications are included within the scope of the invention.

In act 520, a determination is made by processor 318 as to whether the marking operation is complete. For example, the user may indicate that it is necessary to install another marking dispenser of the same color in order to complete the marking operation or may indicate that another facility is to be marked at the same site, thus requiring installation of a marking dispenser of a different color. When the marking operation is not complete, the process returns to act 510.

When the marking operation is complete, as determined in act 520, the ID and/or marker information which has been stored in storage device 322 and/or transmitted to a remote device is ready for offline processing. By way of example only, offline processing may include compilation of data for a particular job site or determination of trends and statistics for multiple users. In addition, the ID and/or marker information may be processed for the purpose of tracking the inventory of marking paint dispensers., More specifically, the ID and/or marker information may be processed in order to analyze the usage of marking dispensers, such as the number of dispensers used and by what users. In another example, the ID and/or marker information may be processed for the purpose of quality control, such as to verify that the proper marking substances have been used in the assigned marking operations. The use of the ID and/or marker information is not limited to that mentioned above. The ID and/or marker information may be used for any purpose (e.g., real-time product verification, tracking what user location received what batch of marking paint, tracking marking paint inventory, tracking marking paint problems, tracking marking paint usage, and the like).

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A marking apparatus to mark a presence or an absence of an underground facility in a dig area, the marking apparatus comprising:

a housing configured to enable dispensing of a marker onto the ground for marking the presence or the absence of the underground facility in the dig area;

at least one marking dispenser to hold the marker;

a marking dispenser holder affixed to the housing to hold the at least one marking dispenser;

an actuator to cause dispensing of the marker from the at least one marking dispenser onto the ground in the dig area, in a marking operation, to mark the presence or the absence of an underground facility;

at least one reader device to read ID information from an ID mechanism affixed to the at least one marking dispenser; and a processing device coupled to the at least one reader device and configured to generate marker information in response to the ID information received from the at least one reader device, the marker information representing at least one characteristic of the marker.

2. A marking apparatus as defined in claim 1, wherein the reader device comprises a radio frequency identification reader.

3. A marking apparatus as defined in claim 1, wherein the reader device comprises a barcode reader.

4. A marking apparatus as defined in claim 1, wherein the marking dispenser holder comprises a spray paint can holder.

5. A marking apparatus as defined in claim 1, wherein the reader device is configured to read at least a product code from the ID mechanism.

6. A marking apparatus as defined in claim 1, wherein the processing device is configured to automatically control at least one operation of the marking apparatus in response to the ID information.

7. A marking apparatus as defined in claim 1, further comprising a communication system, wherein the processing device is configured to transmit at least part of the marker information to a remote device using the communication system.

8. A marking apparatus as defined in claim 1, further comprising a local memory, wherein the processing device is configured to store at least part of the marker information in the local memory.

9. A marking apparatus as defined in claim 1, further comprising a user interface, wherein the processing device is configured to provide at least part of the marker information to the user interface.

10. A marking apparatus as defined in claim 1, further comprising a display device, wherein the processing device is configured to display at least part of the marker information on the display device.

11. A marking apparatus as defined in claim 1, further comprising one or more indicators, wherein the processing device is configured to activate at least one of the indicators in response to the marker information.

12. A marking apparatus as defined in claim 1, wherein the reader device is activated to read the ID information from the ID mechanism in response to dispensing of the marker from the marking dispenser.

13. A marking apparatus as defined in claim 1, wherein the reader device is activated to read the ID information from the ID mechanism in response to a user input.

14. A marking apparatus as defined in claim 1, wherein the reader device is activated to read the ID information from the ID mechanism in response to power up of the marking apparatus.

15. A marking apparatus as defined in claim 1, wherein the reader device is activated to read the ID information from the ID mechanism at periodic intervals.

16. A marking apparatus as defined in claim 1, wherein the reader device is activated to read the ID information from the ID mechanism in response to installation of a marking dispenser in the marking dispenser holder.

17. A marking apparatus as defined in claim 1, wherein the processing device is configured to compare information based on the ID information with reference information and to automatically inhibit dispensing of the marker in the absence of a match.

18. A marking apparatus as defined in claim 1, further comprising a communication system, wherein the processing device is configured to transmit at least part of the marker information to a remote device for inventory analysis.

19. A marking apparatus to mark a presence or an absence of an underground facility in a dig area, the marking apparatus comprising:

a housing configured to enable dispensing of a marker onto the ground for marking the presence or the absence of the underground facility in the dig area;

at least one marking dispenser to hold the marker;

a marking dispenser holder affixed to the housing to hold at least one marking dispenser, the marker dispenser holder including a spray paint can holder;

an actuator to cause dispensing of the marker from the at least one marking dispenser onto the ground in the dig area, to mark the presence or the absence of the underground facility;

at least one reader device to read ID information from an ID mechanism affixed to the marking dispenser;

a processing device coupled to the at least one reader device and configured to generate marker information in response to the ID information received from the at least one reader device, the marker information representing at least one characteristic of the marker; and one or more indicators, wherein the processing device is configured to activate at least one of the indicators in response to the marker information.

20. The marking apparatus according to claim 19, wherein the one or more indicators comprises a plurality of LEDs and wherein the processing device is further configured to activate a first LED of the plurality of LEDs having a color corresponding to a color of the marker in response to the ID information received from the reader device.

21. The marking apparatus according to claim 19, wherein the processor is further configured to inhibit actuation of the marking dispenser in response to a conflict between reference information related to the marking operation and ID information received from the reader device.

22. The marking apparatus according to claim 20, wherein the reference information is entered by an operator of the marking apparatus.

* * * * *

UNITED STATES PATENT AND TRADEMARK OFFICE

CERTIFICATE OF CORRECTION

PATENT NO. : 8,473,209 B2
APPLICATION NO. : 12/429929
DATED : June 25, 2013
INVENTOR(S) : Nielsen et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 412 days.

Signed and Sealed this
Twenty-third Day of December, 2014

Michelle K. Lee

Michelle K. Lee
*Deputy Director of the United States Patent and Trademark Office*